US008662112B2

(12) United States Patent
Teng et al.

(10) Patent No.: US 8,662,112 B2
(45) **Date of Patent: *Mar. 4, 2014**

(54) WEAVING MACHINES AND THREE-DIMENSIONAL WOVEN FABRICS

(75) Inventors: Yung-Shun Teng, Taipei (TW); Yang-Ping Shih, New Taipei (TW); Li-Yun Chang, New Taipei (TW)

(73) Assignee: Taiwan Textile Research Institute, New Taipei (TW)

( * ) Notice: Subject to any disclaimer, the term of this patent is extended or adjusted under 35 U.S.C. 154(b) by 9 days.

This patent is subject to a terminal disclaimer.

(21) Appl. No.: 13/480,100

(22) Filed: May 24, 2012

(65) Prior Publication Data

US 2012/0227855 A1 Sep. 13, 2012

Related U.S. Application Data

(60) Continuation-in-part of application No. 13/179,426, filed on Jul. 8, 2011, now Pat. No. 8,286,668, which is a division of application No. 12/642,353, filed on Dec. 18, 2009, now Pat. No. 8,015,999.

(30) Foreign Application Priority Data

Dec. 4, 2009 (TW) ..... 98141578 A

(51) Int. Cl.
*D03D 27/08* (2006.01)
*D03D 27/10* (2006.01)
*D03D 39/22* (2006.01)

(52) U.S. Cl.
USPC ..... 139/26; 139/11; 139/25; 139/DIG. 1

(58) Field of Classification Search
USPC ..... 139/25, 26
See application file for complete search history.

(56) References Cited

U.S. PATENT DOCUMENTS

| | | | | |
|---|---|---|---|---|
| 2,515,389 | A * | 7/1950 | Campbell et al. | 139/115 |
| 2,834,806 | A | 5/1958 | Jamrogowicz | |
| 2,835,277 | A | 5/1958 | Groat | |
| 3,048,198 | A | 8/1962 | Koppelman et al. | |
| 3,101,747 | A * | 8/1963 | Hindle | 139/109 |
| 3,302,665 | A * | 2/1967 | McHargue | 139/25 |
| 3,498,337 | A * | 3/1970 | Hindle | 139/110 |
| 3,526,252 | A * | 9/1970 | Hindle et al. | 139/110 |
| 3,626,989 | A * | 12/1971 | Held | 139/121 |
| 3,753,451 | A * | 8/1973 | Hosono et al. | 139/110 |

(Continued)

FOREIGN PATENT DOCUMENTS

| | | |
|---|---|---|
| DE | 1535486 | 8/1969 |
| EP | 0271021 | 6/1988 |

OTHER PUBLICATIONS

"Search Report of European Counterpart Application", issued on Feb. 1, 2013, p1-p7, in which the listed references were cited.

*Primary Examiner* — Bobby Muromoto, Jr.
(74) *Attorney, Agent, or Firm* — J. C. Patents

(57) ABSTRACT

A three-dimensional distance woven fabric including two outer fabrics, at least one inter-layered fabric and a plurality of inter-yarns connected with each one of the outer fabrics and the inter-layered fabric, wherein a gap between the inter-layered fabrics and each one of the outer fabrics of the three-dimensional distance woven fabric is greater than 20 centimeters and is less than 300 centimeters. A weaving machine and a method for weaving the aforesaid three-dimensional distance woven fabric are also provided.

21 Claims, 13 Drawing Sheets

(56) References Cited

U.S. PATENT DOCUMENTS

| | | | | | |
|---|---|---|---|---|---|
| 3,810,493 | A * | 5/1974 | Mizuno | 139/110 |
| 4,503,113 | A * | 3/1985 | Smart | 442/199 |
| 5,044,408 | A * | 9/1991 | Vandeweghe et al. | 139/115 |
| 5,085,252 | A * | 2/1992 | Mohamed et al. | 139/22 |
| 5,259,420 | A * | 11/1993 | Foster | 139/97 |
| 5,261,465 | A * | 11/1993 | Dore | 139/103 |
| 5,783,279 | A | 7/1998 | Edgson et al. | |
| 5,921,111 | A * | 7/1999 | Maier et al. | 66/87 |
| 5,947,164 | A * | 9/1999 | Norlin | 139/308 |
| 6,135,162 | A * | 10/2000 | Dornier et al. | 139/110 |
| 6,135,163 | A * | 10/2000 | Wahhoud et al. | 139/114 |
| 6,592,069 | B1 * | 7/2003 | Cobble | 242/598 |
| 6,918,410 | B1 * | 7/2005 | Berger | 139/21 |
| 8,015,999 | B2 * | 9/2011 | Teng et al. | 139/11 |
| 8,286,668 | B2 * | 10/2012 | Teng et al. | 139/11 |
| 2001/0014565 | A1 * | 8/2001 | Qiu et al. | 442/221 |
| 2004/0171318 | A1 * | 9/2004 | Rashed | 442/33 |
| 2006/0057920 | A1 * | 3/2006 | Wigent, III | 442/221 |
| 2006/0219313 | A1 * | 10/2006 | Gstrein et al. | 139/383 A |
| 2006/0249217 | A1 * | 11/2006 | Nayfeh et al. | 139/11 |
| 2007/0107796 | A1 * | 5/2007 | Nayfeh et al. | 139/11 |
| 2008/0156043 | A1 * | 7/2008 | Gustin | 66/4 |
| 2009/0025544 | A1 * | 1/2009 | Mohamed | 87/8 |
| 2009/0253326 | A1 * | 10/2009 | Gstrein et al. | 442/326 |
| 2010/0043908 | A1 * | 2/2010 | Mohamed | 139/384 R |
| 2011/0014403 | A1 * | 1/2011 | Wang et al. | 428/34.1 |

* cited by examiner

WEAVING MACHINES AND THREE-DIMENSIONAL WOVEN FABRICS

CROSS-REFERENCE TO RELATED APPLICATION

This is a continuation-in-part application of and claims the priority benefit of U.S. application Ser. No. 13/179,426, filed on Jul. 8, 2011. The prior U.S. application Ser. No. 13/179,426 is a divisional application of and claims the priority benefit of U.S. application Ser. No. 12/642,353, filed on Dec. 18, 2009, which claims the priority benefit of Taiwan application serial no. 98141578, filed on Dec. 4, 2009. The entirety of each of the above-mentioned patent applications is hereby incorporated by reference herein and made a part of this specification.

BACKGROUND OF THE INVENTION

1. Field of the Invention

The present invention relates to a weaving machine. More particularly, the present invention relates to a weaving machine for fabricating three-dimensional woven fabrics.

2. Description of Related Art

Under the trend of globalization, the fabrics industry is facing severe competition, and fabric manufacturers have to continue researching and developing new technology and diversified products to keep up with the competition worldwide. Recently, not only fantastic exterior design of the textiles or fabrics is required, but also comfortable and protective fabrics are required. Accordingly, fabrics with multiple functionalities have become mainstream products.

Several methods for fabricating three-dimensional distance fabrics have been proposed by prior arts. For example, three-dimensional distance fabrics are often applied to fabrics for construction engineering, floating ships, protection buffer fabrics, flooring, and so on. The gap between two outer fabrics of the distance fabric is usually required to be greater than 1 centimeter. In addition, the gap between two outer fabrics of the three-dimensional distance fabrics is modified according to different applications. Nowadays, three-dimensional distance fabrics with superior gap are often fabricated by velvet weaving machines. The gap of the distance fabrics fabricated by velvet weaving machines is about 20 centimeters at most. Obviously, distance fabrics with a gap greater than 20 centimeters cannot be fabricated by velvet weaving machines. Accordingly, how to fabricate three-dimensional distance fabrics with a gap greater than 20 centimeters to meet different design requirements is an important issue to be solved.

SUMMARY OF THE INVENTION

The present application provides a three-dimensional woven fabric having superior gap greater than 20 centimeters and a method for weaving the same.

The application further provides a three-dimensional distance woven fabric including two outer fabrics, at least one inter-layered fabric and a plurality of inter-yarns connected with each one of the outer fabrics and the inter-layered fabric, wherein a gap between the inter-layered fabrics and each one of the outer fabrics of the three-dimensional distance woven fabric is greater than 20 centimeters and is less than 50 centimeters.

In an embodiment of the present application, the distance between the inter-layered fabrics and each one of the outer fabrics is greater than 50 centimeters and is less than 100 centimeters.

In an embodiment of the present application, the distance between the inter-layered fabrics and each one of the outer fabrics is greater than 100 centimeters and is less than 200 centimeters.

In an embodiment of the present application, the distance between the inter-layered fabrics and each one of the outer fabrics is greater than 200 centimeters and is less than 300 centimeters.

The application further provides a method for weaving a three-dimensional distance woven fabric including two outer fabrics, at least one inter-layered fabric and a plurality of inter-yarns connected with each one of the outer fabrics and the inter-layered fabric, comprising: providing and transferring a plurality of warps through a warp let-off mechanism including at least one first warp beam and at least two second warp beams; driving and dividing the warps provided by the first warp beam into at least three warp layers by a plurality of heald frames such that a first shed is formed between two adjacent warp layers, wherein a plurality of vertically arranged heald wires are supported by each of the heald frames, each of the heald wires having a heald eye for the warps passing through; transferring wefts to pass through the first shed along a transferring direction by a picking mechanism; pushing the wefts by a beating-up mechanism such that the wefts and the warps are interwoven to form the outer fabrics and the inter-layered fabric, wherein the heald frames are located between the warp let-off mechanism and the beating-up mechanism; passing through the first shed along a direction substantially parallel to the transferring direction and raising parts of the warps provided by one of the second warp beams by a yarn raising mechanism, wherein the parts of the warps raised by the yarn raising mechanism functions as the inter-yarns, and the yarn raising mechanism is separate from the heald frames; driving and dividing the warps provided by the first warp beam into at least three warp layers by heald frames such that a second shed is formed between two adjacent warp layers; transferring wefts to pass through the second shed along the transferring direction by the picking mechanism; pushing the wefts by the beating-up mechanism such that the wefts and the warps are interwoven to form the outer fabrics and the inter-layered fabric; passing through the second shed along the direction substantially parallel to the transferring direction and raising parts of the warps provided by another one of the second warp beams by the yarn raising mechanism; and adjusting and controlling latitude density of the three-dimensional distance woven fabric by a take-up mechanism.

In an embodiment of the present application, the warp let-off mechanism has at least three back rests corresponding to the first warp beam and the second warp beams.

In an embodiment of the present application, the back rests comprises at least one first back rest and at least two second back rests, wherein parts of the warps functioning as the inter-yarns are provided by the second back rests, the other parts of the warps are provided by the first back rest, and each of the second back rests is a movable active back rest.

In an embodiment of the present application, the movable active back rest moves towards the heald frames when the parts of the warps functioning as the inter-yarns are pulled by the yarn raising mechanism.

In an embodiment of the present application, the yarn raising mechanism moves to the top of the first shed and the second shed such that the parts of the warps functioning as the inter-yarns are pulled upwardly.

In an embodiment of the present application, the yarn raising mechanism in the first shed or in the second shed moves towards the take-up mechanism such that the parts of the warps functioning as the inter-yarns are pulled laterally.

In an embodiment of the present application, the yarn raising mechanism is operationally individually from the heald frames.

In an embodiment of the present application, the take-up mechanism comprises a first active roller, a second active roller and a plurality of driven rollers, the one of the two outer fabrics of the three-dimensional distance woven fabric is in contact with the first active roller, and another one of the two outer fabrics of the three-dimensional distance woven fabric is in contact with the second active roller.

In an embodiment of the present application, the diameter of the first active roller is greater than the diameter of the second active roller.

In an embodiment of the present application, the diameter of the first active roller is substantially the same with the diameter of the second active roller.

In an embodiment of the present application, the linear velocity of the first active roller is substantially the same with the linear velocity of the second active roller.

In order to make the aforementioned and other objects, features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 1' schematically illustrates that the yarn raising mechanism extends into the shed and pulls parts of the warps.

DESCRIPTION OF EMBODIMENTS

Figure 1:
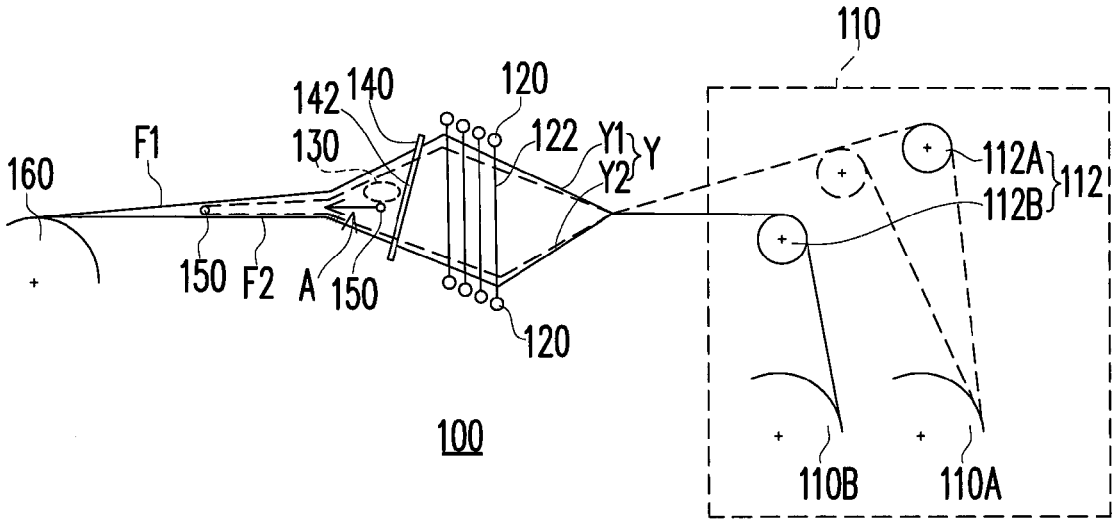
FIG. 1 is a schematic side view of a weaving machine according to an embodiment of the present application.
Figure 1:
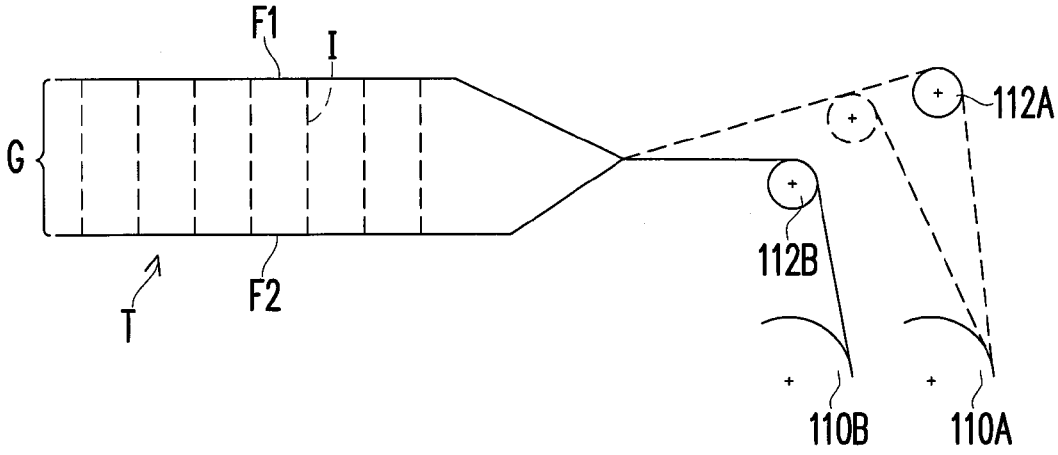
Figure 1:
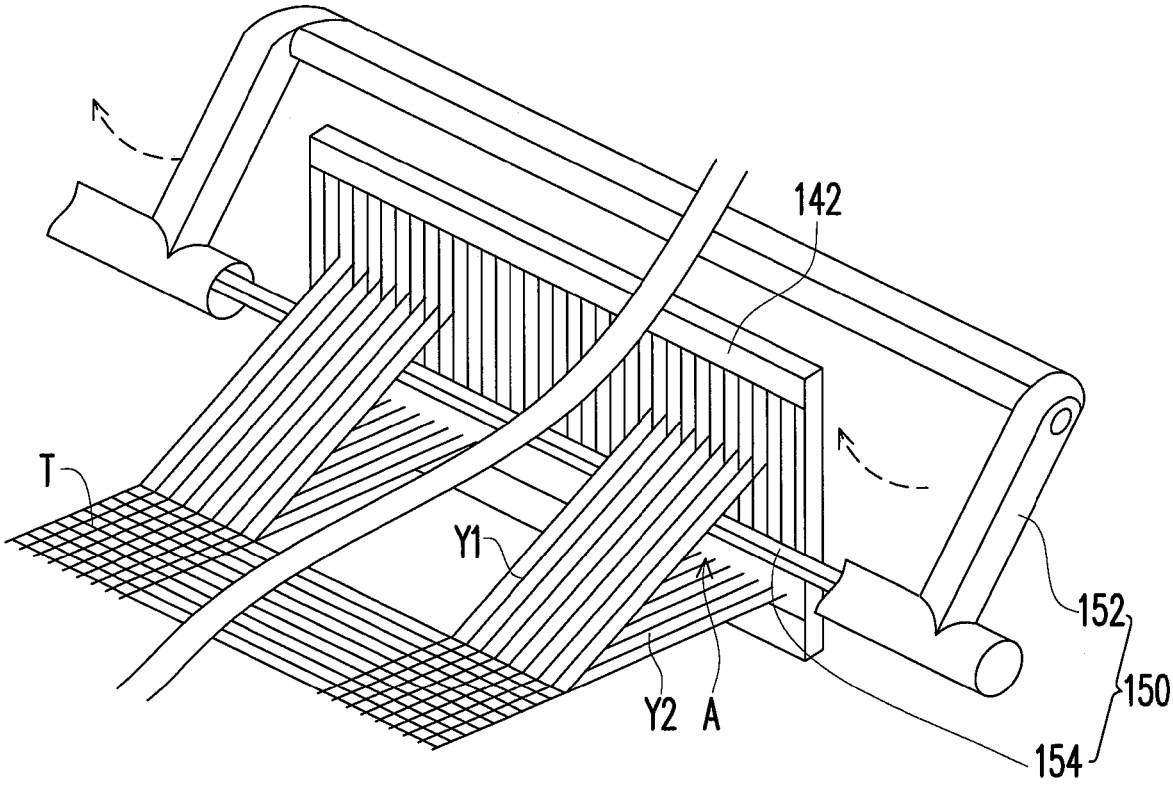

FIG. 1 is a schematic side view of a weaving machine according to an embodiment of the present application. Referring to FIG. 1, in this embodiment, the weaving machine 100 for weaving a three-dimensional distance woven fabric T includes two outer fabrics F1, F2 and a plurality of inter-yarns I connected with the outer fabrics F1, F2. As shown in FIG. 1, the weaving machine 100 includes a warp let-off mechanism 110, a plurality of heald frames 120, a picking mechanism 130, a beating-up mechanism 140, a yarn raising mechanism 150, and a take-up mechanism 160. The warp let-off mechanism 110 includes at least two warp beams 110A, 110B for providing and transferring a plurality of warps Y. A plurality of vertically arranged heald wires 122 are supported by each of the heald frames 120, wherein each of the heald wires 122 has a heald eye (not shown) for the warps Y passing through. The warps Y are driven from two warp beams, and divided into two warp layers Y1, Y2 by the heald frames 120 such that a shed A is formed between the two warp layers Y1, Y2. The picking mechanism 130 transfers weft to pass through the shed A between the warp layers Y1, Y2. The beating-up mechanism 140 (e.g. a reed 142) is suitable for pushing the wefts such that the wefts and the warps Y are interwoven to form the outer fabrics F1, F2. The heald frames 120 are located between the warp let-off mechanism 110 and the beating-up mechanism 140. The yarn raising mechanism 150 is suitable for passing through the shed A and raising parts of the warps Y functioning as inter-yarns I. The take-up mechanism 160 is suitable for adjusting and controlling latitude density of the three-dimensional distance woven fabric T. In addition, the beating-up mechanism 140 is located between the heald frames 120 and the take-up mechanism 160.

In this embodiment, the warp let-off mechanism 110 has at least two back rests 112 corresponding to the warp beams 110A, 110B. Specifically, parts of the warps Y functioning as the inter-yarns I are provided by the first back rest 110A, and the other parts of the warps Y are provided by the second back rest 110B. Here, the warps Y provided from the second back rest 110B are used to fabricate the outer fabrics F1, F2. It is noted that the number of the heald frames 120 is relevant to fabric structure such as pattern, fabric density, and formation, etc. . . . One ordinary skilled in the art may modify the number of the heald frames 120 according to the aforementioned fabric structure based on actual requirements.

In order to simultaneously move with the yarn raising mechanism 150, the first back rest 112A may be a movable active back rest. The first back rest 112A (i.e. the movable active back rest) moves towards the heald frames 120 simultaneously when the parts of the warps Y functioning as the inter-yarns I are pulled by the yarn raising mechanism 150. It is noted that the first back rest 112A may includes at least one movable roller while the second back rest 112B may includes at least one roller. The warps Y are transferred through rotation of the above-mentioned rollers.

In this embodiment, the gap G between the outer fabrics F1, F2 of the three-dimensional distance woven fabric T can be well adjusted through control of the length of the inter-yarns I. Specifically, the pulling range of the yarn raising mechanism 150 is relevant to the length of the inter-yarns I. In this embodiment, the pulling range of the yarn raising mechanism 150 ranges from about 10 centimeters to about 150 centimeters. Certainly, the pulling range of the yarn raising mechanism 150 can be properly modified to meet design requirements of other products. It is noted that the pulling direction is properly selected to avoid the moving of the yarn raising mechanism 150 from being obstructed when the inter-yarns I are pulled. Accordingly, by properly selecting the pulling range of the yarn raising mechanism 150, the three-dimensional distance woven fabric T having superior gap G can be integrally-woven.

The three-dimensional distance woven fabric T includes two outer fabrics F1, F2 and a plurality of inter-yarns I connected with the outer fabrics F1, F2, wherein a gap G distance between the outer fabrics F1, F2 of the three-dimensional distance woven fabric T is greater than 20 centimeters. In an embodiment of the present application, the gap G between the outer fabrics F1, F2 is greater than 50 centimeters, for example. In an alternative embodiment of the present application, the gap G distance between the outer fabrics F1, F2 is greater than 100 centimeters or 200 centimeters, for example. It is noted that pulling distance range of the yarn raising mechanism 150 is approximately a half one of the gap G.

In an alternative embodiment of the present application, the yarn raising mechanism 150 moves to the top of the shed A such that the parts of the warps Y functioning as the inter-yarns I can be pulled upwardly, as shown in FIG. 2A to FIG. 2D. However, the pulling direction and the distance range of the yarn raising mechanism 150 are not limited in the present application. For example, the yarn raising mechanism 150 in the shed A can also move towards the take-up mechanism 160 such that the parts of the warps Y functioning as the inter-yarns I are pulled laterally, as shown in FIG. 3A to FIG. 3D.

FIG. 1' schematically illustrates that the yarn raising mechanism extends into the shed and pulls parts of the warps. Referring to FIG. 1', the yarn raising mechanism 150 of this embodiment includes a driving unit 152 and a pulling unit 154 connected with the driving unit 152. Specifically, the pulling unit 154 is suitable for extending into the shed A between the warp layers Y1, Y2. In addition, the pulling unit 154 is driven by the driving unit 152 to move to the top of the shed A or to move towards the take-up mechanism 160. The design of the yarn raising mechanism 150 is limited to the mechanism illustrated in FIG. 1', other mechanical designs may be used in the present application.

Figure 2A:
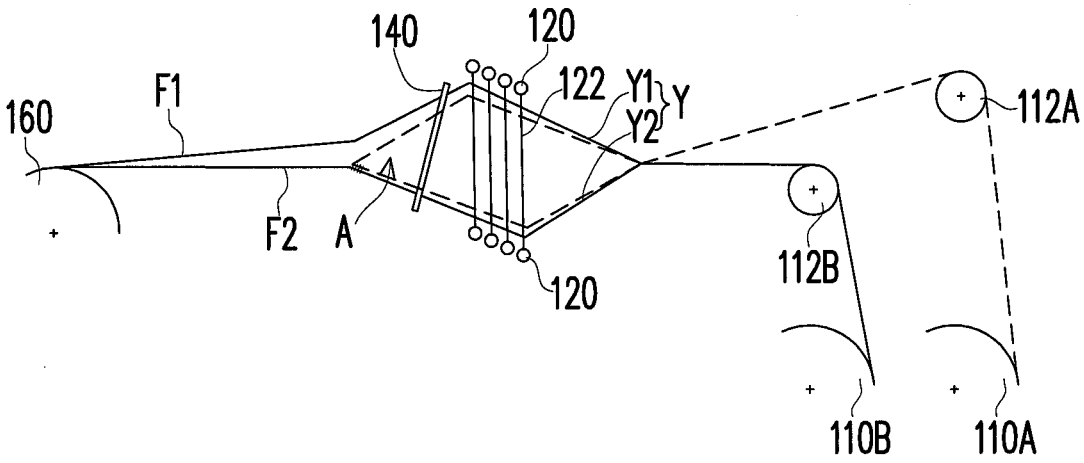
FIG. 2A to FIG. 2D are schematic views illustrating a weaving process according to the first embodiment of the present application.

FIG. 2A to FIG. 2D are schematic views illustrating a weaving process according to the first embodiment of the present application. Referring to FIG. 2A, first, general weaving process including warp let-off procedure, shed forming procedure, wefts-picking procedure, beating-up procedure and take-up procedure are performed continuously such that the outer fabrics F1, F2 are woven.

Figure 2B:
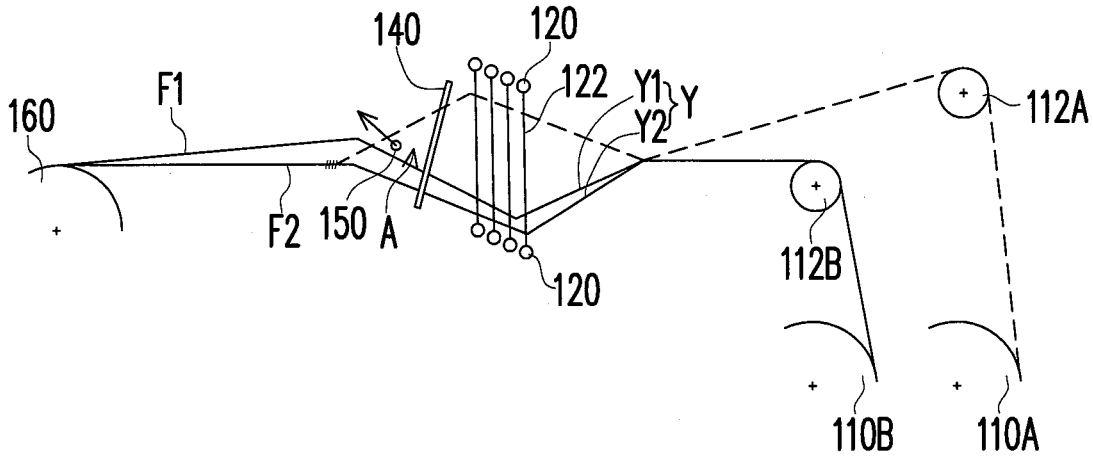
Figure 2C:
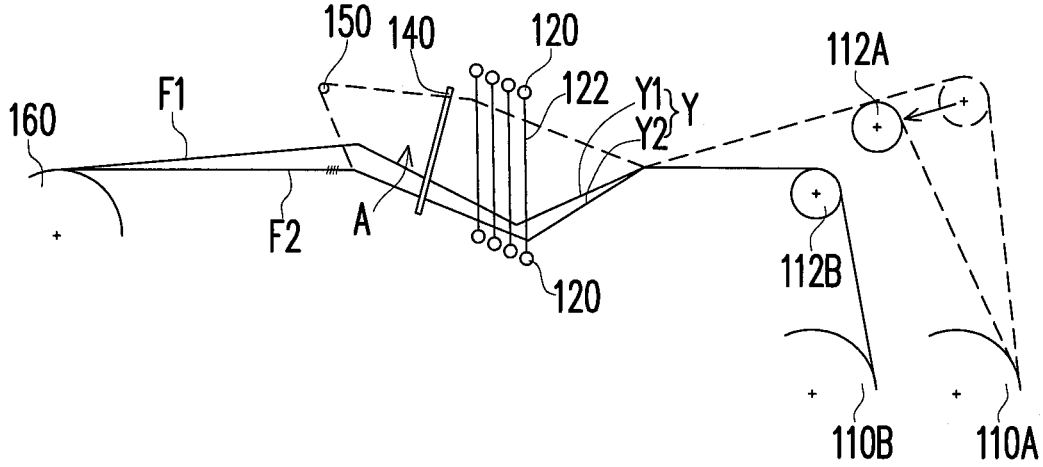

Referring to FIG. 2B and FIG. 2C, the warps Y provided from the warp beam 110B are arranged at the bottom of the shed A and the warps Y provided from the warp beam 110A are arranged at the top of the shed A. At this time, the yarn raising mechanism 150 extends into the shed A from two ends of the shed A and moves upwardly to the top of the shed A. Accordingly, the warps Y arranged at the top of the shed A are pulled upwardly. In this embodiment, the pulling range of the yarn raising mechanism 150 can be properly evaluated and adjusted according to the required gap of the three-dimensional woven fabrics. After the warps Y are pulled upwardly, the yarn raising mechanism 150 is ejected from two ends of the shed A. Meanwhile, the inter-yarns I having predetermined length are located naturally over the outer fabric F1.

Figure 2D:
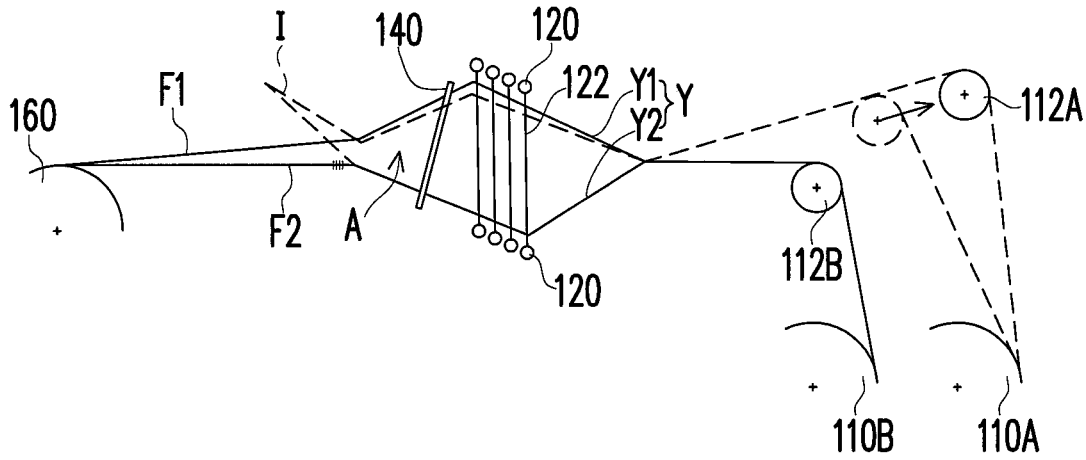

Referring to FIG. 2D, after the warps Y are pulled upwardly, general weaving process including warp let-off procedure, shed forming procedure, picking procedure, beating-up procedure and take-up procedure are performed continuously. It is noted that the number or the frequency of the warps Y being pulled can be properly modified according to actual design requirements.

FIG. 3A to FIG. 3D are schematic views illustrating a weaving process according to the second embodiment of the present application. Referring to FIG. 3A through FIG. 3D, the weaving process of this embodiment is similar with that illustrated in the FIG. 2A through FIG. 2D except that the yarn raising mechanism 150 extends into the shed A from two ends of the shed A and moves towards the take-up mechanism 160 such that the parts of the warps Y functioning as the inter-yarns I are pulled laterally.

Figure 4:
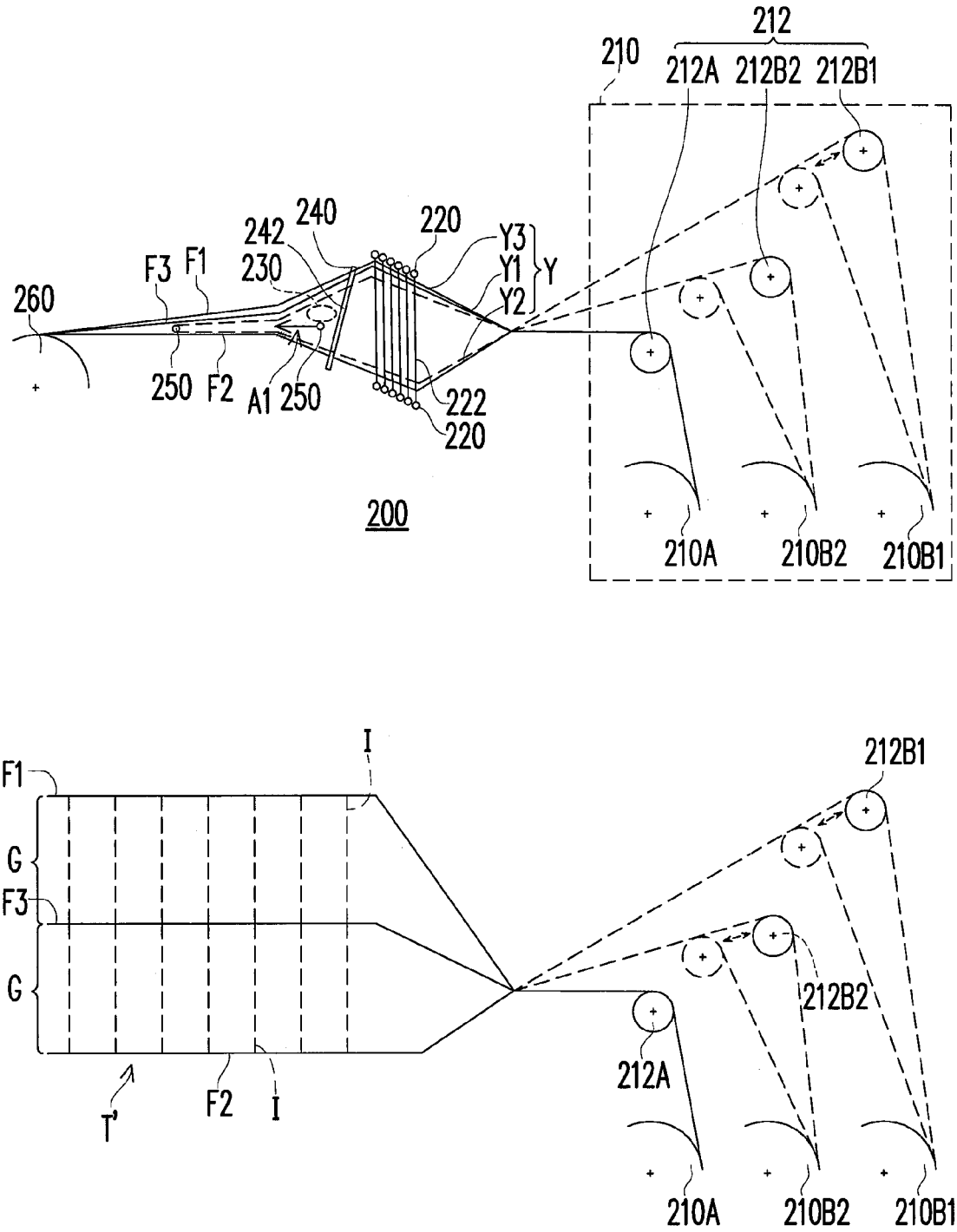
FIG. 4 is a schematic side view of a weaving machine according to the third embodiment of the present application.

FIG. 4 is a schematic side view of a weaving machine according to the third embodiment of the present application. Referring to FIG. 1, in this embodiment, the weaving machine 200 for weaving a three-dimensional distance woven fabric T' includes two outer fabrics F1, F2, at least one inter-layered fabric F3 and a plurality of inter-yarns I connected with each one of the outer fabrics F1, F2 and the inter-layered fabric F3. As shown in FIG. 4, the weaving machine 200 includes a warp let-off mechanism 210, a plurality of heald frames 220, a picking mechanism 230, a beating-up mechanism 240, a yarn raising mechanism 250 separate from the heald frames 220, and a take-up mechanism 260. The warp let-off mechanism 210 includes at least one first warp beam 210A and at least two second warp beams 210B1 and 210B2 for providing and transferring a plurality of warps Y. A plurality of vertically arranged heald wires 222 are supported by each of the heald frames 220, wherein each of the heald wires 222 has a heald eye (not shown) for the warps Y passing through. The warps Y are provided from the first warp beam 210A, and divided into at least three warp layers Y1, Y2, and Y3 by the heald frames 220 such that a first shed A1 is formed between the two warp layers Y1, Y2. The picking mechanism 230 transfers weft to pass through the first shed A1 between the warp layers Y1, Y2 along a transferring direction. The beating-up mechanism 240 (e.g. a reed 242) is suitable for pushing the wefts such that the wefts and the warps Y1, Y2 are interwoven to form the outer fabrics F1, F2 and the inter-layered fabric F3. The heald frames 220 are located between the warp let-off mechanism 210 and the beating-up mechanism 240. The yarn raising mechanism 250 is suitable for passing through the first shed A1 along a direction substantially parallel to the transferring direction and raising parts of the warps Y provided by the second warp beam 210B1. The parts of the warps Y raised by the yarn raising mechanism 250 function as inter-yarns I. The take-up mechanism 260 is suitable for adjusting and controlling latitude density of the three-dimensional distance woven fabric T'. In addition, the beating-up mechanism 240 is located between the heald frames 220 and the take-up mechanism 260.

The density of the wefts used in the vicinity of the intersections of the inter-yarns I and the outer fabrics F1, F2 can be adjusted properly, such that the latitude density of the outer fabrics F1, F2 in the vicinity of the intersections of the inter-yarns I and the outer fabrics F1, F2 is greater than the latitude density of the outer fabrics F1, F2 at the other area of the outer fabrics F1, F2. For example, the density of the weft can be increased through cramming motion. When the density of the wefts used in the vicinity of the intersections of the inter-yarns I and the outer fabrics F1, F2 increases, the inter-yarns I are tied up by the wefts in the vicinity of the intersections of the inter-yarns I and the outer fabrics F1, F2, and the position of the inter-yarns I cannot shift significantly. Moreover, the position of the inter-yarns I can be ensured by using thin wefts having smaller diameter and increasing the quantity of the wefts used in the vicinity of the intersections of the inter-yarns I and the outer fabrics F1, F2.

Figure 3A:
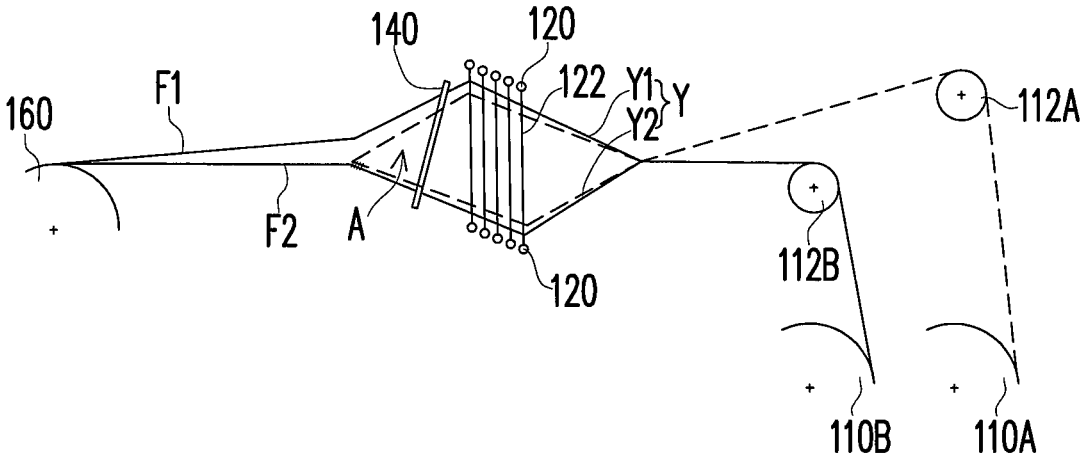
FIG. 3A to FIG. 3D are schematic views illustrating a weaving process according to the second embodiment of the present application.
Figure 3B:
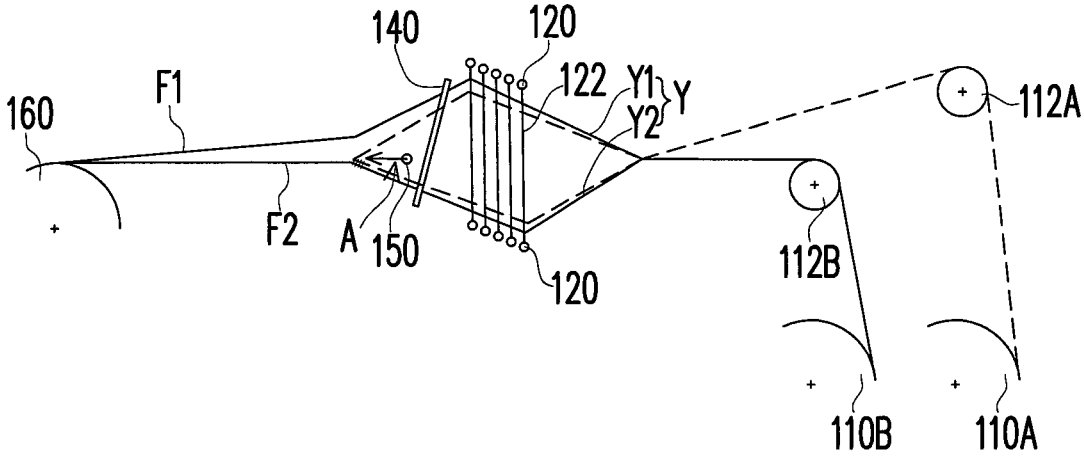
Figure 3C:
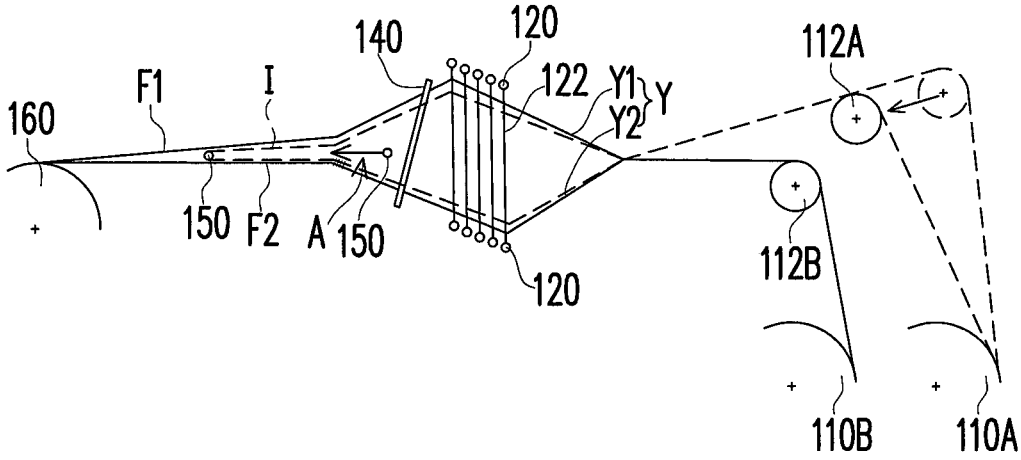
Figure 3D:
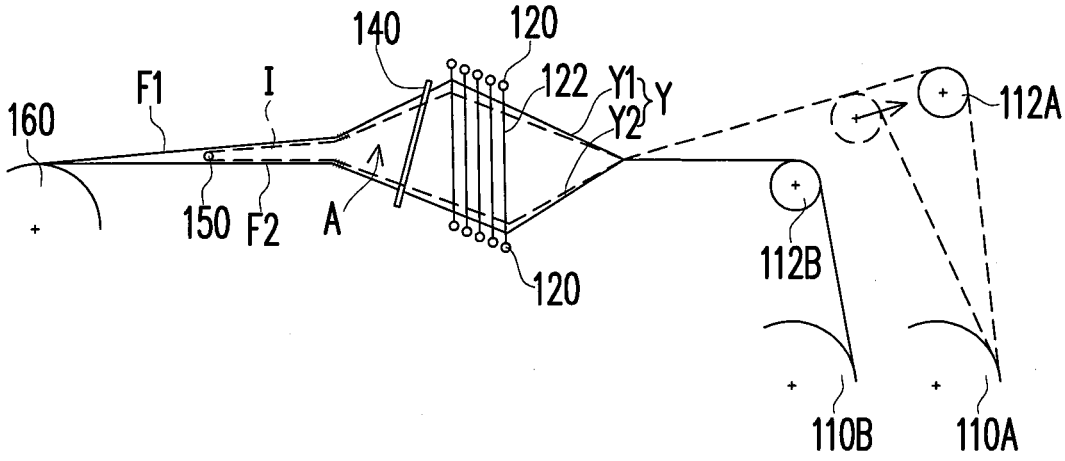

It is noted that the parts of warps Y located in the first shed A1 can be raised in the manner disclosed in FIG. 2C and FIG. 3C. Specifically, the yarn raising mechanism 250 moves upwardly to the top of the first shed A1 (as shown in FIG. 2C)

or moves towards the take-up mechanism 260 (as shown in FIG. 2C) so as to raise the parts of warps Y functioning as the inter-yarns I.

Figure 5A:
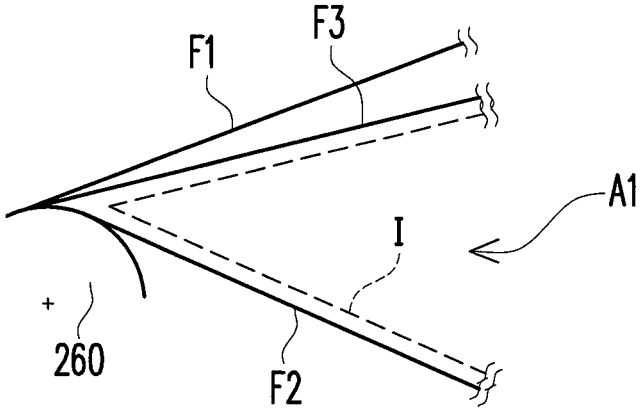
FIG. 5A to FIG. 5B are schematic views illustrating a weaving process according to the second embodiment of the present application.
Figure 5B:
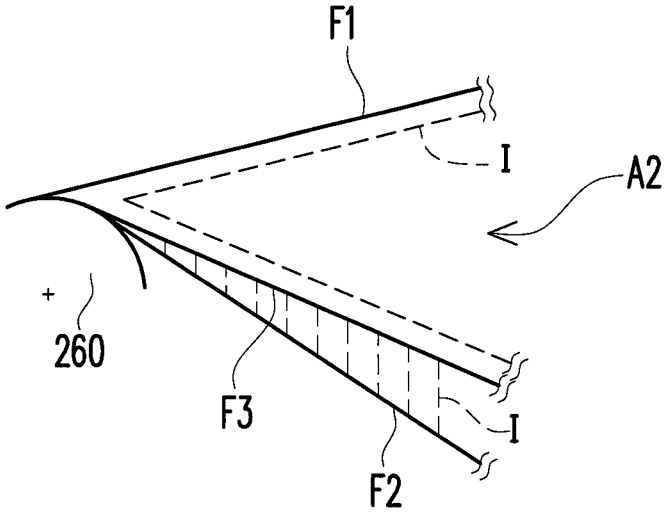

FIG. 5A to FIG. 5B are schematic views illustrating a weaving process according to the second embodiment of the present application. Referring to FIG. 5A, in the weaving process of this embodiment (the third embodiment), the first shed A1 between the outer fabric F2 and the inter-layered fabric F3 is formed first, and the inter-yarns I between the outer fabric F2 and the inter-layered fabric F3 are pull upwardly or laterally.

Referring to FIG. 5B, after the inter-yarns I between the outer fabric F2 and the inter-layered fabric F3 are raised, a second shed A2 between the outer fabric F1 and the inter-layered fabric F3 is then formed, and the inter-yarns I between the outer fabric F1 and the inter-layered fabric F3 are raised upwardly or laterally.

Figure 6A:
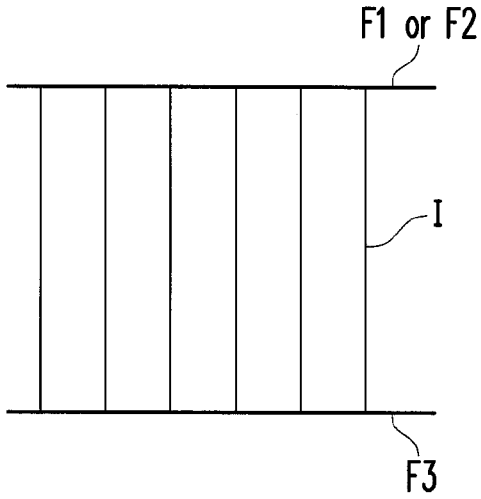
FIG. 6A through FIG. 6I are various types of inter-yarns.
Figure 6B:
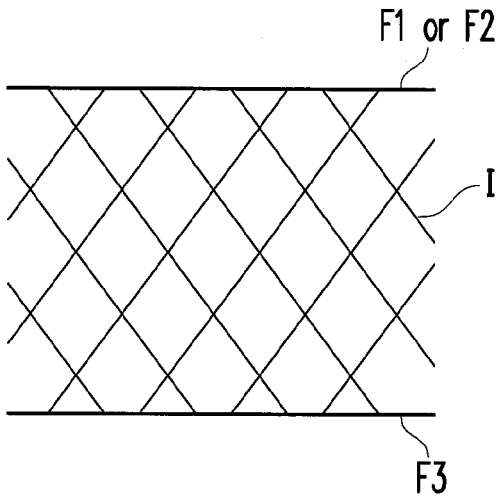
Figure 6C:
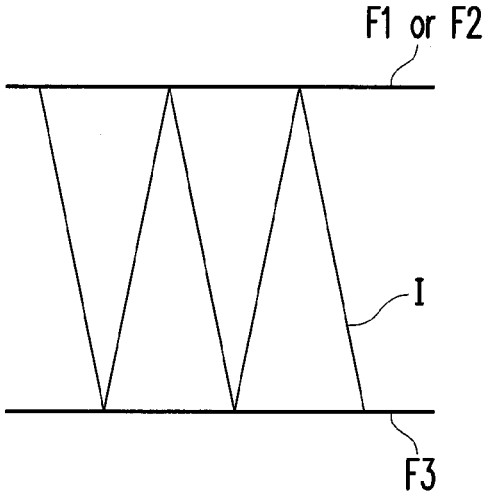
Figure 6D:
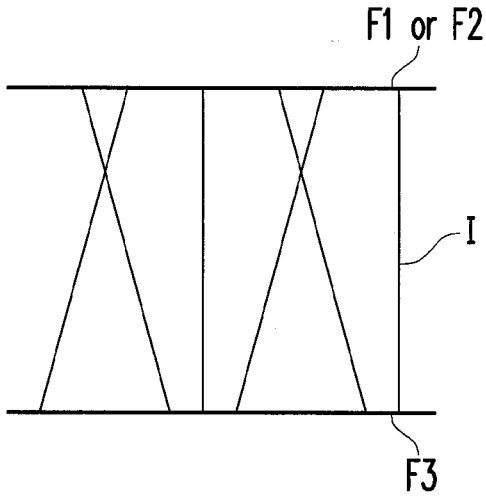
Figure 6E:
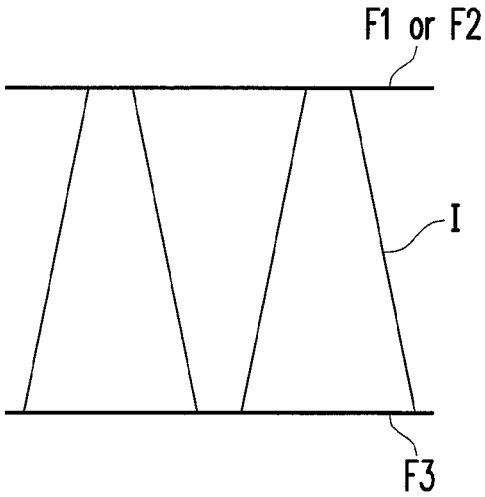
Figure 6F:
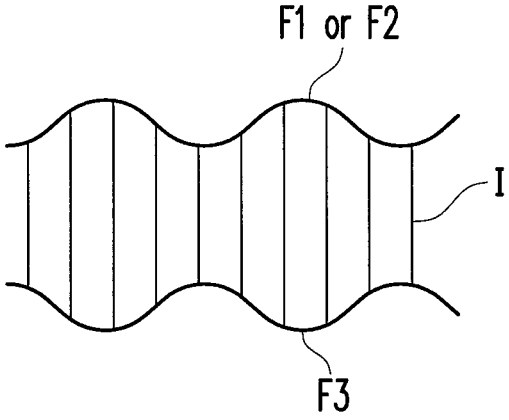
Figure 6G:
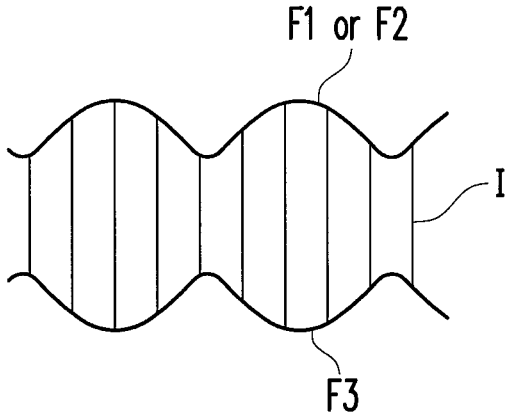
Figure 6H:
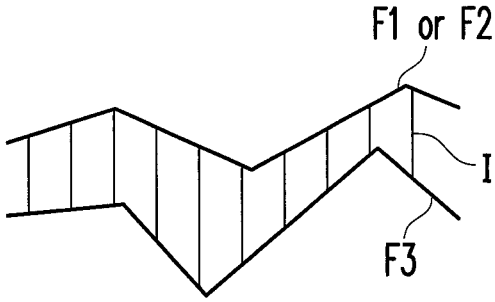
Figure 6I:
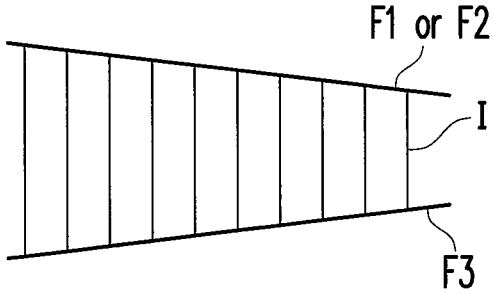

It is noted that the inter-yarns I between the outer fabric F1 and the inter-layered fabric F3 may be parallel with each other (FIG. 6A), intersected with each other (FIG. 6B) or arranged in other manners (FIG. 6C, FIG. 6D or FIG. 6E). The inter-yarns I between the outer fabric F2 and the inter-layered fabric F3 may be parallel with each other (FIG. 6A), intersected with each other (FIG. 6B) or arranged in other manners (FIG. 6C, FIG. 6D or FIG. 6E). Further, the arrangement of the inter-yarns I between the outer fabric F1 and the inter-layered fabric F3 may be substantially identical with or different from that of the inter-yarns I between the outer fabric F2 and the inter-layered fabric F3. In an alternative embodiment, the outer fabric F1 is not parallel with the inter layered fabric F3 and the outer fabric F2 is not parallel with the inter layered fabric F3. As shown in FIG. 6F, FIG. 6G, FIG. 6H or FIG. 6I, the gap between the inter layered fabric F3 and the outer fabric F1 and the gap between the inter layered fabric F3 and the outer fabric F2 may vary according to actual design requirements. In addition, the outer surface of the outer fabric F1 or the outer fabric F2 is a curved surface or constitutes of a plurality of plane surfaces, for example.

In an embodiment of the present application, the warp let-off mechanism has at least three back rests 212A, 212B1 and 212B2 corresponding to the first warp beam 210A and the second warp beams 210B1, 210B2.

In an embodiment of the present application, the back rests comprises at least one first back rest 212A and at least two second back rests 212B1 and 212B2, wherein parts of the warps functioning as the inter-yarns I are provided by the second back rests 212B1 and 212B2, the other parts of the warps are provided by the first back rest 212A, and each of the second back rests 212B1, 212B2 is a movable active back rest. Specifically, the second back rests 212B1, 212B2 (i.e. the movable active back rest) are capable of moving towards the heald frames 220 or moving upwardly when the parts of the warps Y functioning as the inter-yarns I are pulled or raised by the yarn raising mechanism 250. However, the movable active back rest may have alternative designs. For example, the movable active back rest may have a structure shown in FIG. 8.

Figure 7A:
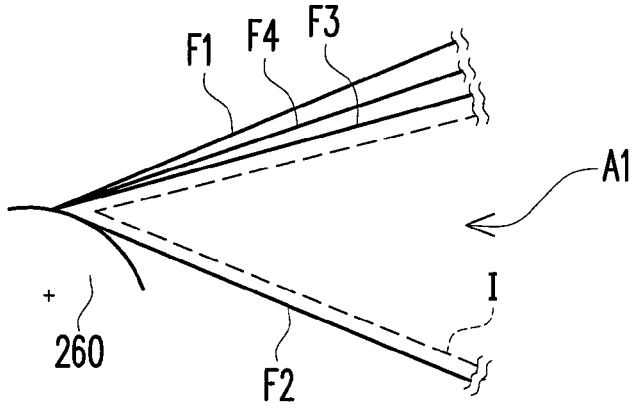
FIG. 7A to FIG. 7C are schematic views illustrating a weaving process according to the second embodiment of the present application.
Figure 7B:
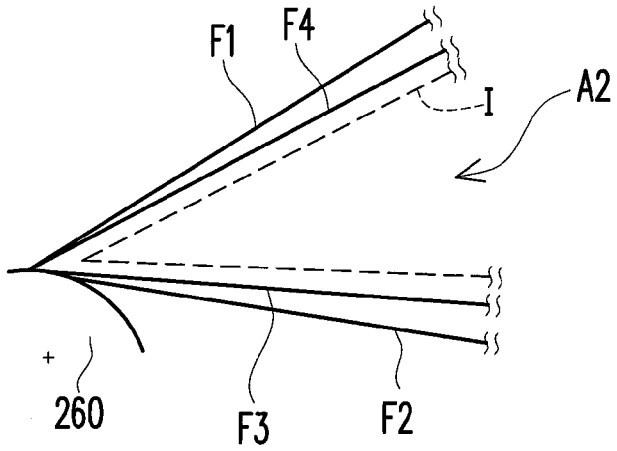
Figure 7C:
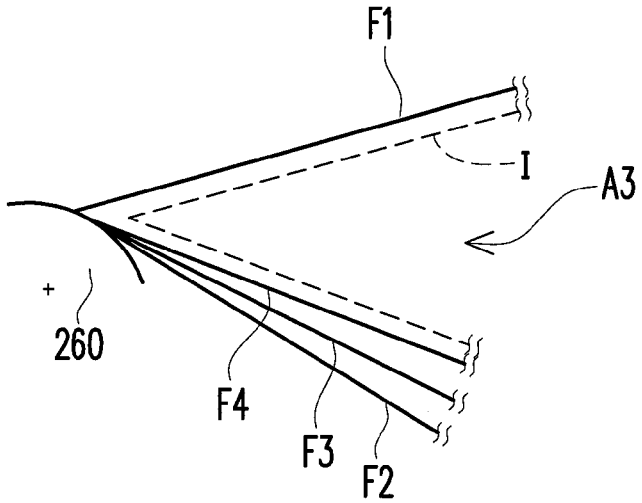

FIG. 7A to FIG. 7C are schematic views illustrating a weaving process according to the second embodiment of the present application. Referring to FIG. 7A, in the weaving process of this embodiment (the third embodiment), a first shed A1 between the outer fabric F2 and the inter-layered fabric F3 is formed first, and the inter-yarns I between the outer fabric F2 and the inter-layered fabric F3 are pull upwardly or laterally.

Referring to FIG. 7B, after the inter-yarns I between the outer fabric F2 and the inter-layered fabric F3 are raised, a second shed A2 between the inter-layered fabric F3 and the inter-layered fabric F4 is then formed, and the inter-yarns I between the inter-layered fabric F3 and the inter-layered fabric F4 are raised upwardly or laterally.

Referring to FIG. 7C, after the inter-yarns I between the inter-layered fabric F3 and the inter-layered fabric F4 are raised, a third shed A3 between the inter-layered fabric F4 and the outer fabric F1 is then formed, and the inter-yarns I between the inter-layered fabric F4 and the outer fabric F1 are raised upwardly or laterally.

It is noted that the inter-yarns I between the outer fabric F1 and the inter-layered fabric F3 may be parallel with each other (FIG. 6A), intersected with each other (FIG. 6B) or arranged in other manners (FIG. 6C, FIG. 6D or FIG. 6E). The inter-yarns I between the inter-layered fabric F3 and the inter-layered fabric F4 may be parallel with each other (FIG. 6A), intersected with each other (FIG. 6B) or arranged in other manners (FIG. 6C, FIG. 6D or FIG. 6E). The inter-yarns I between the inter-layered fabric F4 and the outer fabric F1 may be parallel with each other (FIG. 6A), intersected with each other (FIG. 6B) or arranged in other manners (FIG. 6C, FIG. 6D or FIG. 6E). Further, the arrangement of the inter-yarns I between the outer fabric F1 and the inter-layered fabric F3, the arrangement of the inter-yarns I between the inter-layered fabric F3 and the inter-layered fabric F4 and the arrangement of the inter-layered fabric F4 and the outer fabric F1 may be substantially identical with each other or different from each other. In an alternative embodiment, the outer fabric F1 is not parallel with the inter layered fabric F3 and the outer fabric F2 is not parallel with the inter layered fabric F3. As shown in FIG. 6F, FIG. 6G, FIG. 6H or FIG. 6I, the gap between the inter layered fabric F3 and the outer fabric F1 and the gap between the inter layered fabric F3 and the outer fabric F2 may vary according to actual design requirements. In addition, the outer surface of the outer fabric F1 or the outer fabric F2 is a curved surface or constitutes of a plurality of plane surfaces, for example.

It is noted that the gap between the fabrics of the three-dimensional distance woven fabric can be varied locally such that the profile of the fabrics may have waved-outline. Additionally, the gap between any two adjacent fabrics can be modified according to actual design requirements by one ordinary skilled in the art.

The present application provides a weaving machine for fabricating three-dimensional woven fabrics having superior gap without significantly increasing costs. In addition, the three-dimensional distance woven fabrics of the present application may easily have a gap greater than 20 centimeters.

In order to optimize the performance of weaving machine of the present application, the detail design of the movable active back rest, temples for clamping fabrics, and the take-up mechanism are described as follow.

Movable Active Back Rest

Figure 8:
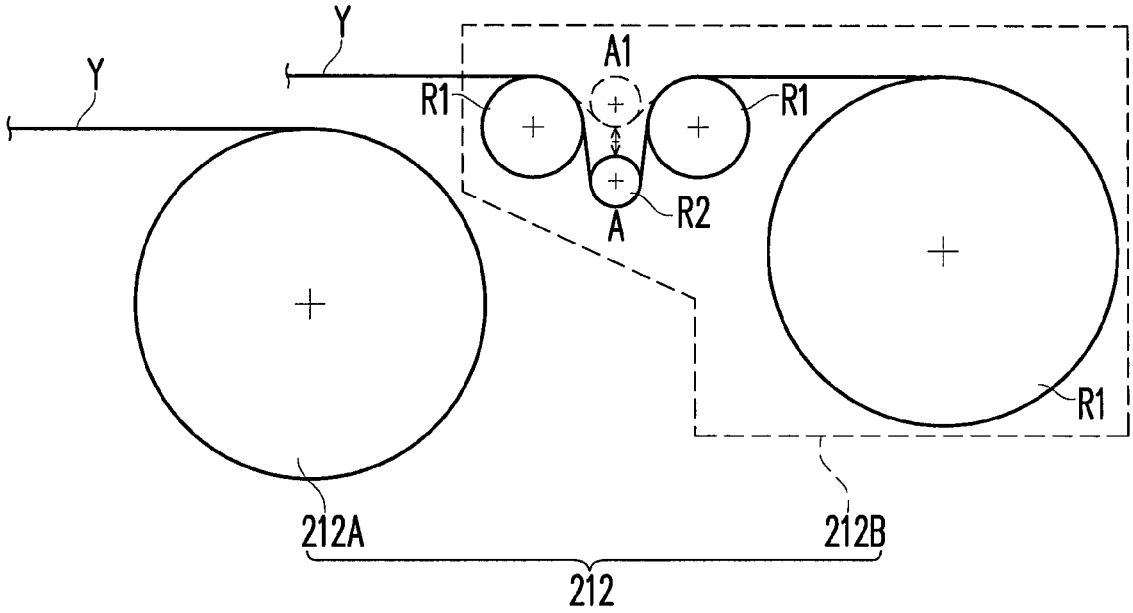
FIG. 8 schematically illustrates a movable active back rest according to an alternative embodiment of the present application.

FIG. 8 schematically illustrates a movable active back rest according to an alternative embodiment of the present application. Referring to FIG. 4 and FIG. 8, the back rests 212 comprises at least one first back rest 212A and at least two second back rests 212B1 and 212B2. Each of the second back rests 212B1 and 212B2 is a movable active back rest including a plurality of first rollers R1 and at least one second roller R2. The first rollers R1 are installed at predetermined positions for transmitting the warps Y, and the second roller R2 is movable installed within an operation range. Specifically, the second roller R2 is capable of moving from the position A to the position A1. When the parts of the warps Y functioning as the inter-yarns I are pulled by the yarn raising mechanism 250, the second roller R2 rapidly moves from the position A to the position A1. The distance between the position A and the position A1 is determined by and is proportional to the length of the inter-yarns I.

Due to the rapid motion of the second roller R2, the operation of the yarn raising mechanism 250 can be performed successfully. Accordingly, the active back rest shown in FIG. 8 can transmit the warps Y stably and rapidly.

Temples

Figure 9:
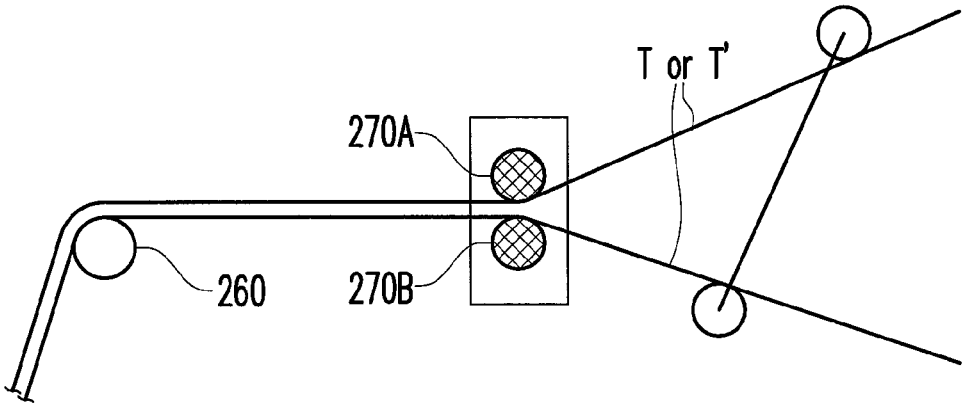
FIG. 9 schematically illustrates a pair of temples for clamping fabrics according to an embodiment of the present application.

FIG. 9 schematically illustrates a pair of temples for clamping fabrics according to an embodiment of the present application. Referring to FIG. 9, after the above-mentioned three-dimensional distance woven fabric T or T' is woven, the three-dimensional distance woven fabric T or T' is clamped by a pair of temples 270A and 270B simultaneously, wherein the temples 270A and 270B are located at opposite sides of the three-dimensional distance woven fabric T or T'. Each of the pair of temples 270A and 270B has a plurality of needle-like structures formed thereon. The pair of temples 270A and 270B with needle-like structures are directly in contact with the surface of the three-dimensional distance woven fabric T or T', such that the three-dimensional distance woven fabric T or T' is laterally driven by the pair of temples 270A and 270B.

Take-Up Mechanism

Figure 10A:
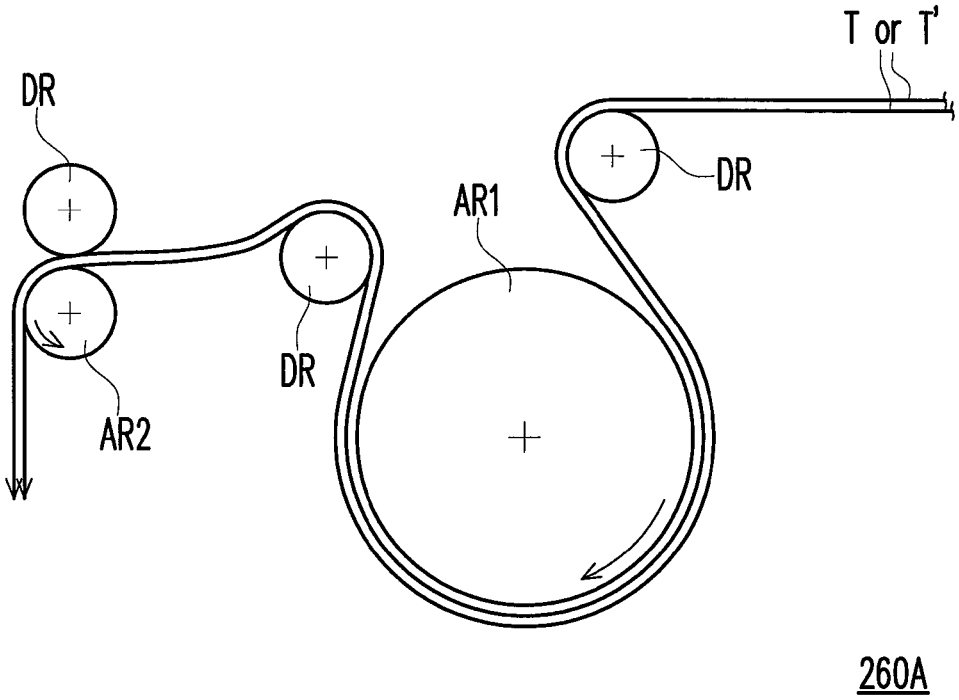
FIG. 10A and FIG. 10B schematically illustrate take-up mechanisms according to different embodiments of the present application.
Figure 10B:
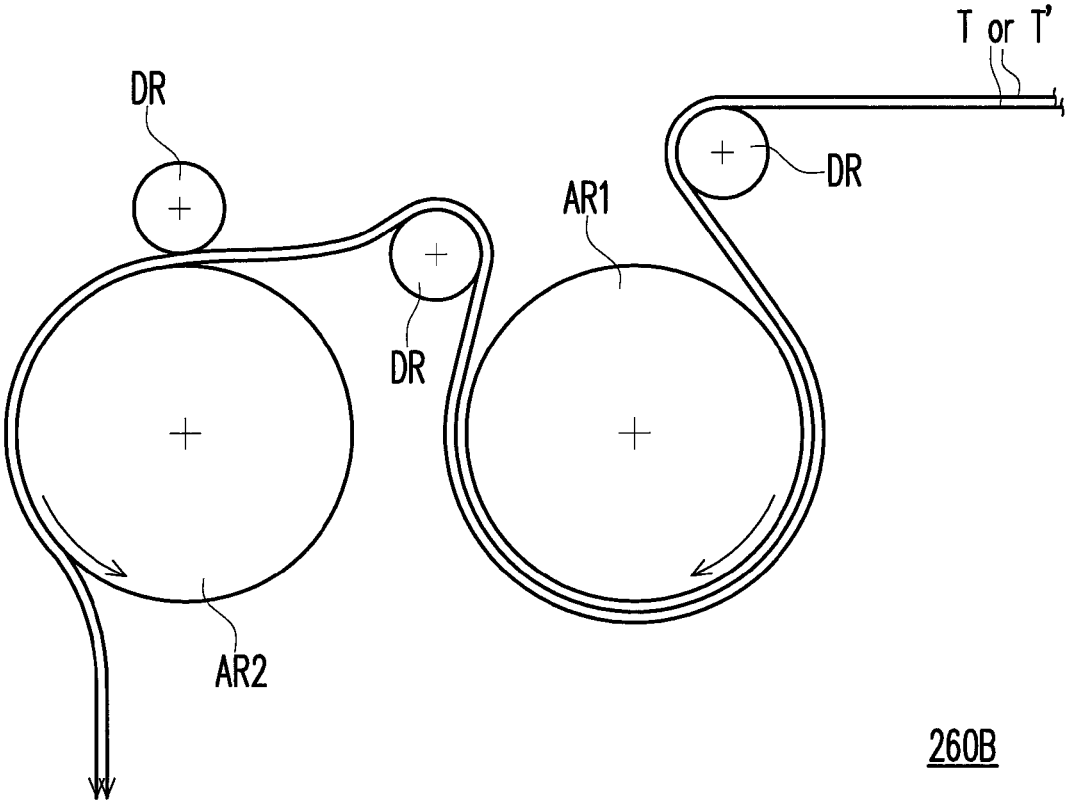

FIG. 10A and FIG. 10B schematically illustrate take-up mechanisms according to different embodiment of the present application. Referring to FIG. 10A, the take-up mechanism 260A includes a first active roller AR1, a second active roller AR2 and a plurality of driven rollers DR. Since one outer surface of the three-dimensional distance woven fabric T or T' is directly in contact with the first active roller AR1 and another outer surface of the three-dimensional distance woven fabric T or T' is directly in contact with the second active roller AR2, the relative position between the outer fabrics the three-dimensional distance woven fabric T or T' can be maintained when being taken-up.

It is note that the linear velocity of the first active roller AR1 is substantially the same with the linear velocity of the second active roller AR2. As shown in FIG. 10A, the diameter of the first active roller AR1 is greater than the diameter of the second active roller AR2. Additionally, the angular velocity of the first active roller AR1 is lower than the angular velocity of the second active roller AR2.

Referring to FIG. 10A and FIG. 10B, the take-up mechanism 260B shown in FIG. 10B is similar to the take-up mechanism 260A shown in FIG. 10A except that the diameter of the first active roller AR1 is greater than the diameter of the second active roller AR2.

It is noted that the linear velocity of the first active roller AR1 is substantially the same with the linear velocity of the second active roller AR2. Additionally, the angular velocity of the first active roller AR1 is substantially the same with the angular velocity of the second active roller AR2.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A three-dimensional distance woven fabric including two outer fabrics, at least one inter-layered fabric and a plurality of inter-yarns connected with each of the outer fabrics and the inter-layered fabrics, fabricated by a process comprising the step of:

providing and transferring a plurality of warps through a warp let-off mechanism including at least one first warp beam and at least two second warp beams;

driving and dividing the warps provided by the first warp beam into at least three warp layers by a plurality of heald frames such that a first shed is formed between two adjacent warp layers, wherein a plurality of vertically arranged heald wires are supported by each of the heald frames, each of the heald wires having a heald eye for the warps passing through;

transferring wefts to pass through the first shed along a transferring direction by a picking mechanism;

pushing the wefts by a beating-up mechanism such that the wefts and the warps are interwoven to form one of the two outer fabrics and the at least one inter-layered fabric located between the two outer fabrics, wherein the heald frames are located between the warp let-off mechanism and the beating-up mechanism;

passing through the first shed along a direction substantially parallel to the transferring direction and raising parts of the warps provided by one of the second warp beams by a yarn raising mechanism, wherein the parts of the warps raised by the yarn raising mechanism functions as the plurality of inter-yarns connected with each of the outer fabrics and the inter-layered fabrics, and the yarn raising mechanism is separate from the heald frames;

driving and dividing the warps provided by the first warp beam into at least three warp layers by heald frames such that a second shed is formed between two adjacent warp layers;

transferring wefts to pass through the second shed along the transferring direction by the picking mechanism;

pushing the wefts by the beating-up mechanism such that the wefts and the warps are interwoven to form another one of the two outer fabrics and the at least one inter-layered fabric located between the two outer fabrics;

passing through the second shed along the direction substantially parallel to the transferring direction and raising parts of the warps provided by another one of the second warp beams by the yarn raising mechanism; and adjusting and controlling latitude density of the three-dimensional distance woven fabric by a take-up mechanism, wherein a gap distance between the inter-layered fabrics and each one of the outer fabrics is between 20-300 cm.

2. The three-dimensional distance woven fabric of claim 1, wherein the distance between the inter-layered fabrics and each one of the outer fabrics is greater than 50 centimeters and is less than 100 centimeters.

3. The three-dimensional distance woven fabric of claim 1, wherein the distance between the inter-layered fabrics and each one of the outer fabrics is greater than 100 centimeters and is less than 200 centimeters.

4. The three-dimensional distance woven fabric of claim 1, wherein the distance between the inter-layered fabrics and each one of the outer fabrics is greater than 200 centimeters and is less than 300 centimeters.

5. A method for weaving a three-dimensional distance woven fabric including two outer fabrics, at least one inter-layered fabric and a plurality of inter-yarns connected with each one of the outer fabrics and the inter-layered fabric, comprising:

providing and transferring a plurality of warps through a warp let-off mechanism including at least one first warp beam and at least two second warp beams;

driving and dividing the warps provided by the first warp beam into at least three warp layers by a plurality of heald frames such that a first shed is formed between two adjacent warp layers, wherein a plurality of vertically arranged heald wires are supported by each of the heald frames, each of the heald wires having a heald eye for the warps passing through;

transferring wefts to pass through the first shed along a transferring direction by a picking mechanism;

pushing the wefts by a beating-up mechanism such that the wefts and the warps are interwoven to form one of the outer fabrics and the inter-layered fabric, wherein the heald frames are located between the warp let-off mechanism and the beating-up mechanism;

passing through the first shed along a direction substantially parallel to the transferring direction and raising parts of the warps provided by one of the second warp beams by a yarn raising mechanism, wherein the parts of the warps raised by the yarn raising mechanism functions as the inter-yarns, and the yarn raising mechanism is separate from the heald frames;

driving and dividing the warps provided by the first warp beam into at least three warp layers by heald frames such that a second shed is formed between two adjacent warp layers;

transferring wefts to pass through the second shed along the transferring direction by the picking mechanism;

pushing the wefts by the beating-up mechanism such that the wefts and the warps are interwoven to form another one of the outer fabrics and the inter-layered fabric;

passing through the second shed along the direction substantially parallel to the transferring direction and raising parts of the warps provided by another one of the second warp beams by the yarn raising mechanism; and adjusting and controlling latitude density of the three-dimensional distance woven fabric by a take-up mechanism.

6. The method of claim 5, wherein the warp let-off mechanism has at least three back rests corresponding to the first warp beam and the second warp beams.

7. The method of claim 6, wherein the back rests comprises:

at least one first back rest; and at least two second back rests, wherein parts of the warps functioning as the inter-yarns are provided by the second back rests, the other parts of the warps are provided by the first back rest, and each of the second back rests is a movable active back rest.

8. The method of claim 7, wherein the movable active back rest moves towards the heald frames when the parts of the warps functioning as the inter-yarns are pulled by the yarn raising mechanism.

9. The method of claim 5, wherein the yarn raising mechanism moves to the top of the first shed and the second shed such that the parts of the warps functioning as the inter-yarns are pulled upwardly.

10. The method of claim 5, wherein the yarn raising mechanism in the first shed or in the second shed moves towards the take-up mechanism such that the parts of the warps functioning as the inter-yarns are pulled laterally.

11. A weaving machine for weaving a three-dimensional distance woven fabric including two outer fabrics, at least one inter-layered fabric and a plurality of inter-yarns connected with each one of the outer fabrics and the inter-layered fabric, the weaving machine comprising:

a warp let-off mechanism, comprising at least one first warp beam and at least two second warp beams for providing and transferring a plurality of warps;

a plurality of vertically arranged heald wires, supported by each of the heald frames, each of the heald wires having a heald eye for the warps passing through, the warps provided by the first warp beam being driven and divided into at least three warp layers by the heald frames, wherein a plurality of sheds are sequentially formed between two adjacent warp layers;

a picking mechanism for sequentially transferring wefts to pass through one of the sheds along a transferring direction;

a beating-up mechanism for pushing the wefts, the wefts and the warps being interwoven to form the outer fabrics and the inter-layered fabric, and the heald frames being located between the warp let-off mechanism and the beating-up mechanism;

a yarn raising mechanism for passing through the sheds along a direction substantially parallel to the transferring direction and raising parts of the warps functioning as the inter-yarns; and a take-up mechanism for adjusting and controlling latitude density of the three-dimensional distance woven fabric.

12. The weaving machine of claim 11, wherein the warp let-off mechanism has at least two back rests corresponding to the first warp beam and the second warp beams.

13. The weaving machine of claim 11, wherein the back rests comprises:

at least one first back rest; and at least two second back rests, wherein parts of the warps functioning as the inter-yarns are provided by the second back rests, the other parts of the warps are provided by the first back rest, and each of the second back rests is a movable active back rest.

14. The weaving machine of claim 13, wherein the movable active back rest moves towards the heald frames when the parts of the warps functioning as the inter-yarns are pulled by the yarn raising mechanism.

15. The weaving machine of claim 11, wherein the yarn raising mechanism moves to the top of the first shed and the second shed such that the parts of the warps functioning as the inter-yarns are pulled upwardly.

16. The weaving machine of claim 11, wherein the yarn raising mechanism in the first shed or in the second shed moves towards the take-up mechanism such that the parts of the warps functioning as the inter-yarns are pulled laterally.

17. The weaving machine of claim 11, wherein the yarn raising mechanism extends into the shed from two ends of the shed, so that the yarn raising mechanism is located between the two warp layers so as to raise parts of the warps functioning as the inter-yarns.

18. The weaving machine of claim 11, wherein the take-up mechanism comprises a first active roller, a second active roller and a plurality of driven rollers, the one of the two outer fabrics of the three-dimensional distance woven fabric is in contact with the first active roller, and another one of the two outer fabrics of the three-dimensional distance woven fabric is in contact with the second active roller.

19. The weaving machine of claim 18, wherein the diameter of the first active roller is greater than the diameter of the second active roller.

20. The weaving machine of claim 18, wherein the diameter of the first active roller is substantially the same with the diameter of the second active roller.

21. The weaving machine of claim 18, wherein the linear velocity of the first active roller is substantially the same with the linear velocity of the second active roller.

* * * * *